US007572407B2

(12) United States Patent
Hirasawa et al.

(10) Patent No.: US 7,572,407 B2
(45) Date of Patent: Aug. 11, 2009

(54) MARTENSITIC STAINLESS STEEL SHEET AND METHOD FOR MAKING THE SAME

(75) Inventors: Junichiro Hirasawa, Chiba (JP); Takumi Ujiro, Chiba (JP); Osamu Furukimi, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/328,598

(22) Filed: Dec. 23, 2002

(65) Prior Publication Data

US 2003/0138342 A1 Jul. 24, 2003

(30) Foreign Application Priority Data

Dec. 26, 2001 (JP) ..... 2001-394433

(51) Int. Cl.

| | |
|---|---|
| ***C22C 38/46*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl. ..... 420/67; 420/64; 420/68; 420/69; 420/119; 420/121; 420/122; 420/124

(58) Field of Classification Search ..... 148/325, 148/326, 608–610, 651, 593; 420/67, 68, 420/69, 64, 119, 121, 122, 124

See application file for complete search history.

(56) References Cited

U.S. PATENT DOCUMENTS

| | | | | |
|---|---|---|---|---|
| 5,624,504 | A * | 4/1997 | Miyakusu et al. | 148/325 |
| 6,475,307 | B1 * | 11/2002 | Nystrom et al. | 148/326 |

FOREIGN PATENT DOCUMENTS

| | | | |
|---|---|---|---|
| EP | 0 732 418 | A1 | 9/1996 |
| EP | 1 006 204 | A1 | 6/2000 |
| FR | 2700174 | * | 7/1994 |
| JP | 61-119654 | | 6/1986 |
| JP | 403188240 | * | 8/1991 |
| JP | 8-199236 | | 8/1996 |
| JP | 9256115 | | 9/1997 |
| JP | 11-172369 | * | 6/1999 |
| JP | 2000-328202 | | 11/2000 |
| JP | 2001-140040 | | 5/2001 |

OTHER PUBLICATIONS

Key To Steel publication, 10 Edition 1974, West Germany.*

(Continued)

*Primary Examiner*—George Wyszomierski
*Assistant Examiner*—Tima M McGuthry-Banks
(74) *Attorney, Agent, or Firm*—DLA Piper LLP (US)

(57) ABSTRACT

A martensitic stainless steel sheet having superior corrosion resistance, toughness at the weld zones, and workability. The composition of the steel sheet is, on a mass basis: less than about 0.02% of carbon; about 1.0% or less of silicon; less than about 1.5% of manganese; about 0.04% or less of phosphorus; about 0.01% or less of sulfur; about 0.1% or less of aluminum; about 1.5% or more and less than about 4.0% of nickel; about 11% or more and less than about 15% of chromium; about 0.5% or more and less than about 2.0% of molybdenum; and less than about 0.02% of nitrogen, the balance being iron and unavoidable impurities, wherein $15.0\% \leqq [Cr]+1.5\times[Mo]+1.2\times[Ni] \leqq 20.0\%$; $[C]+[N]<0.030\%$; $[Ni]+0.5\times([Mn]+[Mo])+30\times[C]>3.0\%$; and $8.0\% \leqq 72\times[C]+40\times[N]+3\times[Si]+2\times[Mn]+4\times[Ni]+[Mo] \leqq 18.0\%$.

44 Claims, 1 Drawing Sheet

OTHER PUBLICATIONS

Keyer, Carl Materials Science in Engineering, second edition, Metal Fabrication and its Effects on Properties, pp. 235-238.*
ASM International, Materials Park, Ohio, Metallographer's Guide: Practcies and Procedures for Irons and Steels, Chapter 1, "Introduction to Steels and Cast Irons", p. 3.*
ASM International, Materials Park, Ohil, Forming and Forging Forging of carbon, alloy and Stainless steels and Heat Resistant alloys, p. 230.*
Machine translation of JP 08-199236 into English, date of patent publication Aug. 6, 1996.*
Machine translation of JP 09-256115 into English, date of patent publication Sep. 30, 1997.*
English abstract of FR 2700174.*
Machine translation of JP 11-172369.*
Chen et al. "Effect of martensite strength on the tensile strength of dual phase steels." Journal of Materials Science, 24 (1989) pp. 1991-1994.*
Machine translation of JP 11-172369, published Jun. 1999.*
English abstract of FR 2700174, published Jul. 1994.*
Keyer, Carl Materials Science in Engineering, second edition, Metal Fabrication and its Effects on Properties, pp. 235-238, 1968.*
ASM International, Materials Park, Ohio, Metallographer's Guide: Practcies and Procedures for Irons and Steels, Chapter 1, "Introduction to Steels and Cast Irons", p. 3, 2001.*
ASM International, Materials Park, Ohil, Forming and Forging Forging of carbon, alloy and Stainless steels and Heat Resistant alloys, p. 230, 1989.*

* cited by examiner

FIGURE
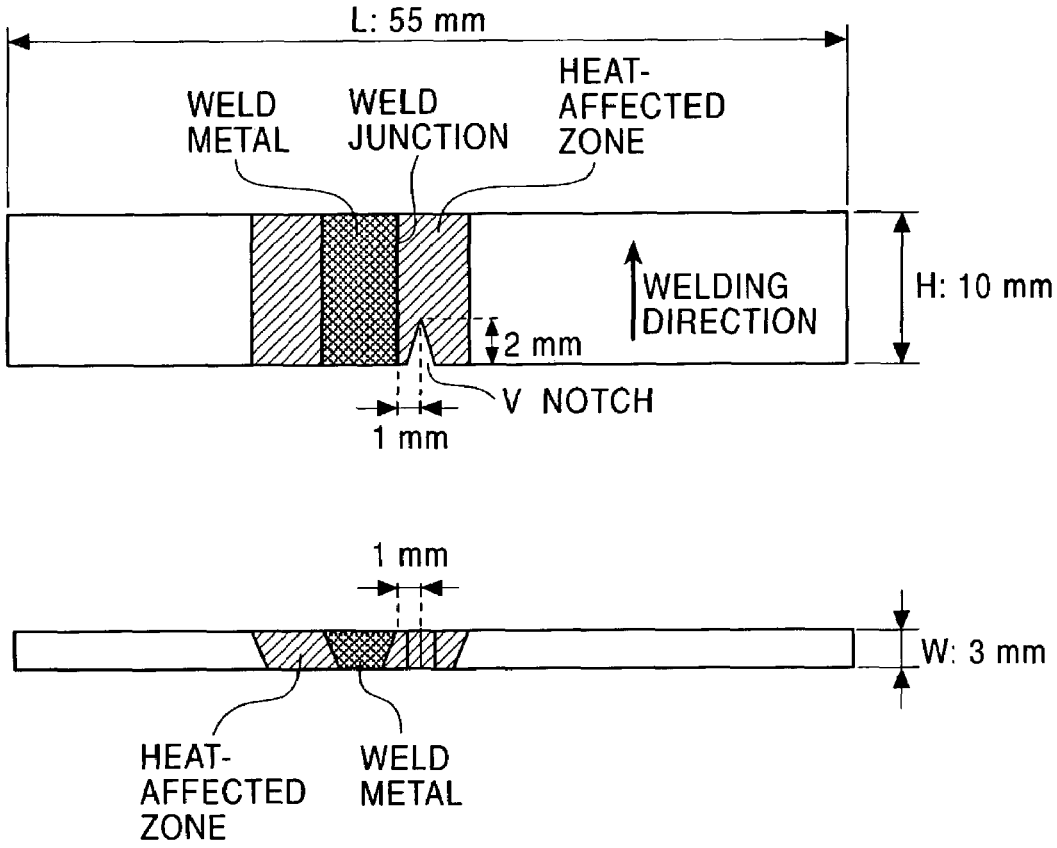

MARTENSITIC STAINLESS STEEL SHEET AND METHOD FOR MAKING THE SAME

BACKGROUND

1. Technical Field

This disclosure relates to a martensitic stainless steel sheet having superior corrosion resistance, toughness at weld zones and workability, and to a method for making the same. In particular, the disclosure relates to a martensitic stainless steel sheet for use in structural components of railway vehicles, automotives, buses, and the like formed by bending and to a method for making the same.

2. Description of the Related Art

Structural components of vehicles, namely railway vehicles, must have high corrosion resistance to maintain cosmetic appearance and to prevent a decrease in strength resulting from thickness reduction due to corrosion. Accordingly, austenitic stainless steel sheets, such as SUS301L and SUS304, having high corrosion resistance have been used in these structural components. Since hot rolled and annealed sheets or cold rolled and annealed sheets of austenitic stainless steel have poor strength, they are temper-rolled, utilizing strain induced martensitic transformation, to increase strength.

However, when vehicle structural components manufactured from austenitic stainless sheets are welded, the weld zones, where heat is input during welding, soften because the strains introduced during temper rolling become released, resulting in a decrease in strength and deterioration of favorable fatigue characteristics at the weld zones. In ferritic stainless sheets, grains in the weld zones coarsen and the toughness of the weld zones dramatically decreases, which is a problem. To overcome these problems, proposals to apply martensitic stainless steel sheets that do not suffer from softening of the weld zones and that have high toughness at the weld zones to vehicle structural components have been made.

For example, Japanese Unexamined Patent Publication No. 7-14542 teaches a martensitic stainless steel sheet having high strength, superior weldability, and high toughness.

However, the technology disclosed in Japanese Unexamined Patent Publication No. 7-14542 is directed to increasing the strength of the steel sheet, i.e., obtaining a high-toughness high-rust-resistance stainless sheet having a strength of 900 MPa or more. Hence, the steel sheet contains large amounts of Mn, Ni, Mo, N, and the like. When this steel sheet is bent, the outer portion of the bent portion cracks and, thus, this steel sheet is not suited for use in vehicle structural components such as those of railway vehicles, automotives, buses and the like, which is a problem.

Although technologies directed to obtaining martensitic stainless sheets having good corrosion resistance, toughness at the weld zones, and strength have been developed, no technology directed to martensitic stainless sheets suitable for use in structural components of vehicles, i.e., martensitic stainless sheets having high workability, particularly, high bendability, in addition to high corrosion resistance and toughness at the weld zones has been developed.

SUMMARY

Accordingly, we provide a martensitic stainless steel sheet having high corrosion resistance, toughness at the weld zones, and processability and a method for making the same.

The martensitic stainless steel sheet and molten metal has the following composition: less than about 0.02% of carbon; about 1.0% or less of silicon; less than about 1.5% of manganese; about 0.04% or less of phosphorus; about 0.01% or less of sulfur; about 0.1% or less of aluminum; about 1.5% or more and less than about 4.0% of nickel; about 11% or more and less than about 15% of chromium; about 0.5% or more and less than about 2.0% of molybdenum; and less than about 0.02% of nitrogen, the balance being iron and unavoidable impurities. The composition of the steel sheet or the molten steel satisfies the following relationships: $15.0\% \leqq [Cr]+1.5\times[Mo]+1.2\times[Ni] \leqq 20.0\%$; $[C]+[N]<0.030\%$; $[Ni]+0.5\times([Mn]+[Mo])+30\times[C]>3.0\%$; and $8.0\% \leqq 72\times[C]+40\times[N]+3\times[Si]+2\times[Mn]+4\times[Ni]+[Mo]18.0\%$. The martensitic stainless steel sheet may be a hot-rolled sheet or a cold-rolled sheet. The method for making the martensitic stainless steel sheet is also provided.

Preferably, at least one of about 2.0% or less of copper and about 2.0% or less of cobalt may be contained in the martensitic steel sheet of the invention. In such a case, the following relationships are preferably satisfied instead of the relationships described above: $15.0\% \leqq [Cr]+1.5\times[Mo]+1.2\times[Ni]+0.5\times[Cu]+0.3\times[Co] \leqq 20.0\%$; $[C]+[N]<0.030\%$; $[Ni]+0.5\times([Mn]+[Mo]+[Cu])+30\times[C]>3.0\%$; and $8.0\% \leqq 72\times[C]+40\times[N]+3\times[Si]+2\times[Mn]+4\times[Ni]+[Mo]+[Cu]+0.8\times[Co] \leqq 18.0\%$.

More preferably, at least one of about 0.2% or less of titanium, about 0.2% or less of niobium, about 0.2% or less of vanadium, about 0.2% or less of zirconium, and about 0.2% or less of tantalum on a mass basis may be contained in the steel sheet. The steel sheet may further contain, on a mass basis, at least one of about 0.005% or less of boron and about 0.005% or less of calcium. Preferably, the steel sheet may further contain, on a mass basis, at least one of about 0.1% or less of tungsten and about 0.01% or less of magnesium.

The steel sheet preferably has a tensile strength of more than about 600 MPa and less than about 900 MPa and is preferably used in vehicle structural components.

It should be noted here that the notation "[ ]" with an element symbol located therein indicates the mass percent of the corresponding element.

BRIEF DESCRIPTION OF THE DRAWING

The drawing shows the arrangement of a metal-inert-gas (MIG) weld zone of a Charpy impact test specimen.

DETAILED DESCRIPTION

Detailed investigations have been conducted on the composition of the martensitic stainless steel sheet as to the effect on the corrosion resistance, toughness of the weld zones, and workability. Based on our findings (1) to (4) below, the composition of the martensitic stainless steel sheet is selected:

(1) the corrosion resistance of a stainless steel sheet containing at least 11 mass percent and less than 15 mass percent of chromium drastically increases by adding adequate amounts of molybdenum and nickel, but molybdenum and nickel in excessive amounts degrade the workability;

(2) the workability and the toughness at the weld zones drastically increases by decreasing the carbon content and the nitrogen content to significantly small values;

(3) the hardenability can be improved and the strength can be increased by adjusting the amounts of carbon, manganese, nickel, and molybdenum within selected ranges; and (4) high strength and high workability can be simultaneously achieved within the ranges that can achieve the effects of (1) to (3) by controlling the amounts of carbon, nitrogen, silicon, manganese, nickel, and molybdenum.

The martensitic stainless steel sheet, hereinafter referred to as the "inventive steel sheet", will now be described in detail. First, the grounds for limiting the composition of the steel sheet are described.

Carbon: Less Than About 0.02 Mass Percent

Carbon (C) decreases workability and toughness at the weld zones and increases susceptibility to weld cracking. Since these adverse effects are significant when carbon is contained in an amount of about 0.02 mass percent or more, the amount of carbon is limited to less than about 0.02 mass percent. More preferably, the amount of carbon is less than about 0.010 mass percent from the point of view of toughness at the weld zones. On the other hand, carbon increases the strength of the steel sheet. Thus, carbon is preferably contained in an amount exceeding about 0.005 mass percent to achieve high strength.

Silicon: About 1.0 Mass Percent or Less

Silicon is an essential element that functions as an antioxidant and increases the strength of the steel sheet. To achieve these effects, the amount of silicon must be at least about 0.10 mass percent. However, silicon in an amount exceeding about 1.0 mass percent decreases the elongation of the steel sheet, embrittles the steel sheet, and decreases the workability and the toughness at the weld zones. Accordingly, the upper limit is about 1.0 mass percent. Preferably, the amount of silicon is about 0.3 mass percent or less from the point of view of toughness at the weld zones.

Manganese: Less Than About 1.5 Mass Percent

Manganese is necessary to obtain an austenite phase at high temperatures, i.e., approximately 1000 to 1100° C., which is characteristic of the martensitic stainless steel sheet. The austenite phase transforms into a fine martensite structure by air cooling and, thus, contributes to increasing the toughness in the zones affected by the welding heat. To achieve this effect, manganese must be contained in an amount of about 0.10 mass percent or more. Manganese in an excessive amount decreases the workability and corrosion resistance of the steel sheet. Accordingly, the amount of manganese is limited to less than about 1.5 mass percent. Preferably, the amount of manganese is about 0.5 mass percent or less from the viewpoint of workability and the corrosion resistance of the steel sheet.

Phosphorus: About 0.04 Mass Percent or Less

Phosphorus (P) decreases the workability of the steel sheets, and the amount of phosphorus is preferably as low as possible. However, since extensive reduction of phosphorus causes an increase in the steel making cost, the upper limit of the phosphorus content is about 0.04 mass percent. The phosphorus content is preferably about 0.02 mass percent or less from the point of view of workability.

Sulfur: About 0.01 Mass Percent or Less

The amount of sulfur (S), which decreases the corrosion resistance, is preferably as low as possible. Since a certain economical limitation is imposed as to the cost of desulfurization in steel making, the amount of sulfur is limited to about 0.01 mass percent or less. The sulfur content is preferably about 0.003 mass percent or less from the point of view of corrosion resistance.

Aluminum: About 0.1 Mass Percent or Less

Aluminum is an essential element that functions as a deoxidizing agent in steel making. To obtain this effect, at least about 0.002 mass percent of aluminum must be contained in the steel sheet. Since aluminum in an excessive amount decreases the corrosion resistance and toughness due to generation of inclusions, the aluminum content is limited to about 0.1 mass percent or less. The aluminum content is more preferably about 0.05 mass percent or less from the point of view of obtaining sufficient toughness at the weld zones.

Ni: About 1.5 Mass Percent or More, and Less Than About 4.0 Mass Percent

Nickel enhances corrosion resistance and increases toughness of the base material and the weld zones. Nickel is also needed to obtain an austenite phase at high temperatures, which is characteristic of the martensitic stainless steel sheet. The amount of nickel should be 1.5 mass percent or more to achieve this effect. On the other hand, nickel in an amount exceeding about 4.0 mass percent causes a significant degree of hardening in the steel sheet and, thus, decreases elongation. The nickel content is limited to less than about 4.0 mass percent. Preferably, the nickel content is about 2.0 mass percent or more from the viewpoint of corrosion resistance. A sufficient effect of improving corrosion resistance can be obtained when nickel is added in an amount of about 3.0 mass percent or less.

Chromium: About 11 Mass Percent or More, and Less Than About 15 Mass Percent

The amount of chromium (Cr), which improves the corrosion resistance of the stainless steel sheet, should be at least about 11 mass percent to obtain sufficient corrosion resistance. The lower limit of the chromium content is about 11 mass percent. From the viewpoint of corrosion resistance, chromium is preferably contained in an amount of about 12 mass percent or more, and more preferably about 13 mass percent or more. On the other hand, chromium decreases the toughness of the steel sheet. Since chromium in an amount of about 15 mass percent or more causes a significant decrease in the toughness, the chromium content is limited to less than about 15 mass percent. Preferably, the chromium content is about 14 mass percent or less from the viewpoint of toughness.

Molybdenum: About 0.5 Mass Percent or More, and Less Than About 2.0 Mass Percent Molybdenum, which increases the corrosion resistance, is added in an amount of about 0.5 mass percent or more. The effect of improving corrosion resistance is saturated and the toughness decreases at a molybdenum content of about 2.0 mass percent or more. Accordingly, the molybdenum content is less than about 2.0 mass percent. Preferably, the molybdenum content is abut 1.0 mass percent or more from the viewpoint of corrosion resistance. Preferably, the molybdenum content is less than about 1.5 mass percent from the point of view of toughness.

Nitrogen: Less Than About 0.02 Mass Percent

As with carbon, nitrogen decreases workability and toughness at the weld zones and increases susceptibility to weld cracking. The adverse effects of nitrogen are acute when nickel is contained in an amount of about 0.02 mass percent or more. Accordingly, the nitrogen content is limited to less than about 0.02 mass percent. Preferably, the nitrogen content is about 0.012 mass percent or less, and most preferably less than about 0.008 mass percent from the viewpoint of workability and toughness at the weld zones.

The composition satisfies relationships (1) to (4):

$$15.0\% \leqq [Cr]+1.5\times[Mo]+1.2\times[Ni] \leqq 20.0\% \quad (1)$$

$$[C]+[N]<0.030\% \text{ (preferably} <0.015\%) \quad (2)$$

$$[Ni]+0.5\times([Mn]+[Mo])+30\times[C]>3.0\% \quad (3)$$

$$8.0\% \leqq 72\times[C]+40\times[N]+3\times[Si]+2\times[Mn]+4\times[Ni]+[Mo] \leqq 18.0\% \quad (4)$$

Relationship (1) is a selected range from the point of view of corrosion resistance and workability. When [Cr]+1.5×[Mo]+1.2×[Ni]<15.0%, the corrosion resistance of the resulting steel sheet is lower than that of austenitic stainless steel sheets such as SUS301L and SUS304. On the other hand, when [Cr]+1.5×[Mo]+1.2×[Ni]>20%, the effect of improving the corrosion resistance is saturated and a significant decrease in the workability occurs due to high-alloying. Thus, the chromium content, molybdenum content, and nickel content satisfies relationship (1) from the viewpoint of corrosion resistance and workability.

The target corrosion resistance of the invention steel sheet is rust area percentage: 30% or less, and maximum pitting depth: 100 μm or less in a combined cyclic corrosion test (CCT). A steel sheet has corrosion resistance sufficient for use in vehicle structural components when the above-described ranges are satisfied. The target workability of the invention steel sheet is elongation: 25% or more in a tensile test described in EXAMPLE 1 below, and no cracking in a bend test. A steel sheet has workability sufficient for use in vehicle structural components when these requirements are satisfied.

Relationship (2) is a limitation from the viewpoint of workability and the toughness in the weld zones. When the sum of the carbon content ([C]) and the nitrogen content ([N]) exceeds 0.030%, workability and toughness at the weld zones are drastically deteriorated.

Accordingly, the carbon and nitrogen content must satisfy relationship (2) from the point of view of workability and the toughness at the weld zones. More preferably, [C]+[N] is less than 0.015% to markedly improve both workability and toughness at the weld zones.

The target workability of the invention steel sheet is the same as that described in relation with relationship (1) above. A steel sheet has superior workability and can be used in vehicle structural components when the steel sheet has an elongation after fracture of about 25% or more in the tensile test and does not crack in the bend test.

Moreover, the target toughness in the weld zones of the invention steel sheet is that the portions affected by the weld heat have a Charpy impact value (vE-50° C.) of about 50 J/cm$^2$ or more in a Charpy impact test described in EXAMPLE 1 below. A steel sheet having a Charpy impact value of about 50 J/cm$^2$ or more has toughness sufficient for use in vehicle structural components.

Relationship (3) is a limitation from the viewpoint of hardenability (tensile strength). When [Ni]+0.5×([Mn]+[Mo])+30×[C]≦3.0%, the volume ratio of the austenite phase generated at a temperature of 900° C. to 1100° C. becomes 80% or less, resulting in failure to increase the strength by hardening and tempering, which is otherwise achieved in martensitic stainless steel. The target strength of the invention steel sheet is a tensile strength exceeding about 600 MPa in a tensile test. A steel sheet having a tensile strength exceeding about 600 MPa has a strength sufficient for use in vehicle structural components.

Relationship (4) is a limitation from the viewpoint of tensile strength and workability. When 72×[C]+40×[N]+3×[Si]+2×[Mn]+4×[Ni]+[Mo]<8.0%, the tensile strength at room temperature decreases to about 600 MPa or less. When 72×[C]+40×[N]+3×[Si]+2×[Mn]+4×[Ni]+[Mo]>18.0%, excessive high-alloying occurs in the steel, the tensile strength at room temperature increases to about 900 MPa or more, and the target workability of the invention cannot be obtained. Accordingly, the carbon ([C]), nitrogen ([N]), silicon ([Si]), manganese ([Mn]), nickel ([Ni]), and molybdenum content ([Mo]) must satisfy relationship (4).

The target strength of the steel sheet is a tensile strength exceeding about 600 MPa and less than about 900 MPa in a tensile test. A steel sheet has a strength sufficient particularly for use in vehicle structural components when the tensile strength thereof exceeds about 600 MPa. A steel sheet having a tensile strength of less than about 900 MPa exhibits an elongation of about 25% or more and, thus, has superior workability such as bendability in addition to strength sufficient for use in vehicle structural components.

A steel sheet having a tensile strength of about 600 MPa or less at room temperature is not suited for use in vehicle structural components, whereas a steel sheet having a tensile strength of about 900 MPa or more is difficult to work, although the strength is sufficient for use in vehicle structural components. Thus, the tensile strength is limited to less than about 900 MPa.

If any one of the above described characteristics, i.e., corrosion resistance, workability, toughness at the weld zones, and tensile strength, is not satisfied, the steel sheet cannot be used in vehicle structural components.

The balance of the steel sheet is iron (Fe) and unavoidable impurities. However, about 0.1 mass percent or less of an alkali metal, an alkali earth metal, a rare earth element, and a transition metal, respectively, may be contained in the invention steel sheet. These elements in an amount of about 0.1 mass percent or less do not affect the advantages of the invention.

Copper and cobalt; titanium, niobium, vanadium, zirconium, and tantalum; boron and calcium; and tungsten and magnesium are not essential components. However, they may be added within the ranges described below.

As with molybdenum, copper (Cu) and cobalt (Co) increase the corrosion resistance. To adequately increase the corrosion resistance, one or both of copper and cobalt are preferably contained in an amount of about 0.02 mass percent or more, and more preferably in an amount of about 0.3 mass percent or more. If each of the copper content and the cobalt content exceeds about 2.0 mass percent, not only the effect is saturated, but also workability and toughness are decreased. Accordingly, the steel sheet may contain one or both of copper and cobalt in an amount of Cu: about 2.0% or less and Co: about 2.0% or less.

When one or both of copper and cobalt are contained, relationships (5), (6), and (7) below should be satisfied instead of relationships (1), (3), and (4). The reasons for the limitation of relationships (5), (6), and (7) are the same as those for the limitation of relationships (1), (3), and (4). In relationships (5), (6), and (7), when only one of copper and cobalt is added and the amount of the element not added to the steel is less than about 0.02 mass percent, the amount of the element not added to the steel is regarded as 0%.

$$15.0\% \leqq [Cr]+1.5\times[Mo]+1.2\times[Ni]+0.5\times[Cu]+0.3\times[Co] \leqq 20.0\% \quad (5)$$

$$[Ni]+0.5\times([Mn]+[Mo]+[Cu])+30\times[C]>3.0\% \quad (6)$$

$$8.0\% \leqq 72\times[C]+40\times[N]+3\times[Si]+2\times[Mn]+4\times[Ni]+[Mo]+[Cu]+0.8\times[Co] \leqq 18.0\% \quad (7)$$

Titanium (Ti), niobium (Nb), vanadium (V), zirconium (Zr), and tantalum (Ta) increase the workability of the steel when contained in minute amounts. The upper limit of the content of each element is about 0.2 mass percent and the lower limit is about 0.02 mass percent to increase the workability. Excessive hardening occurs at an amount exceeding about 0.2 mass percent, resulting in a decrease in the workability. Thus, at least one selected from titanium (Ti), niobium (Nb), vanadium (V), zirconium (Zr), and tantalum (Ta) may be added in an amount of about 0.2 mass percent or less respectively.

Boron (B) and calcium (Ca) increase the strength of the steel sheet even when they are contained in minute amounts. Boron and calcium may be added to the steel sheet as necessary. The content of each element should be at least 0.0005 mass percent to achieve the effect. At a content exceeding about 0.005 mass percent, not only the effect is saturated, but also corrosion resistance is deteriorated. Thus, it is preferable to add one or both of boron and calcium in an amount of about 0.005 mass percent or less.

Tungsten (W) and magnesium (Mg), which increase the strength of the steel sheet, may be added as needed. Tungsten should be contained in an amount of 0.01 mass percent or more to achieve the strengthening effect and magnesium should be contained in an amount of about 0.001 mass percent or more. Toughness decreases when the tungsten content exceeds about 0.1 mass percent or when the magnesium content exceeds about 0.01 mass percent. Thus, one or both of tungsten and magnesium may be added to the steel in amounts of W: about 0.1 mass percent or less and Mg: about 0.01 mass percent or less.

The target characteristics of the invention steel sheet can be summarized as below:

(1) Corrosion Resistance: corrosion resistance sufficient for use in vehicle structural components can be obtained if the rust area percentage is about 30% or less and the corrosion maximum pitting depth is about 100 μm or less in a combined cyclic corrosion test described in EXAMPLE 1 below;

(2) Workability: workability sufficient for use in vehicle structural components can be obtained if elongation is about 25% or more in a tensile test described in EXAMPLE 1 below, and no cracking occurs in the bend test described in EXAMPLE 1 below;

(3) Toughness at the Weld Zones: toughness sufficient for vehicle structural components can be obtained if the Charpy impact value (vE-50° C.) at the zones affected by weld heat is about 50 J/cm$^2$ or more in a Charpy impact test described in EXAMPLE 1 below; and (4) Tensile Strength: the tensile strength should exceed about 600 MPa and should be less than about 900 MPa. A steel sheet is suitable for use in vehicle structural components if the tensile strength thereof exceeds about 600 MPa. Since the tensile strength is less than about 900 MPa, the steel sheet has an elongation after fracture of 25% or more and, thus, exhibits superior workability such as high bendability required in the vehicle structural components.

No limit is imposed as to the methods for making the steel sheet except that the composition of the molten steel should be adjusted as above at the steel melting stage. Methods generally employed in making martensitic steel sheets may be used.

For example, in a steel-making mill having a converter or an electric furnace, a method of refining molten steel containing the above-described essential components and optional components in amounts described above, and then secondary-refining the steel by vacuum oxygen decarburization (VOD) or argon oxygen decarburization (AOD). The refined molten metal may be formed into a slab by known casting methods. A continuous casting method is preferable as the method for making the slab from the viewpoint of production efficiency and quality. The steel slab produced by continuous casting is heated to about 1,000 to about 1,250° C. and hot rolled under normal conditions. For example, the steel slab is formed into a sheet bar having a thickness of about 20 to about 40 mm by a reverse rolling mill and then is made into a hot-rolled sheet having a desired thickness in the range of about 1.5 to about 8.0 mm by a tandem rolling mill. Alternatively, the steel slab may be formed into a hot rolled sheet having a thickness of about 1.5 to about 8.0 mm using only the reverse rolling mill. The resulting hot-rolled sheet may be batch-annealed preferably at about 600 to about 800° C., if necessary. Subsequently, the hot-rolled sheet is subjected to descaling by pickling or the like so as to obtain a hot-rolled sheet product. Depending on the use, the steel may be cold-rolled, annealed at about 700 to about 800° C., and descaled by pickling to make a cold rolled and annealed sheet product having a thickness of about 0.3 to about 3.0 mm.

The hot-rolled sheet product or the cold rolled and annealed sheet product is formed into, for example, a pipe, a panel, or the like, by processing such as bending depending on the usage. The resulting products are used as the structural components, such as poles, bars, or beams, of railway vehicles, automotives, and buses. No limit is imposed as to the method for welding these structural components. Examples of the welding method include conventional arc-welding methods such as metal inert gas (MIG) welding, metal active gas (MAG) welding, and tungsten inert gas (TIG) welding; resistance welding methods such as spot welding and seam welding; high-frequency resistance welding method or high-frequency induction welding method for making electric welded tube.

Because the steel sheet contains lower amounts of carbon and nitrogen to prevent weld cracking, heat treatment after welding is unnecessary and the resulting welded components can be directly used as the structural components. Optionally, heat treatment after welding may be performed to adjust the strength or the like.

EXAMPLE 1

In a vacuum melting furnace, each of 50-kg steel ingot samples having compositions shown in Tables 1 and 2 was refined, heated to 1,200° C., and hot-rolled into a sheet having a thickness of 3 mm using a reverse rolling mill. The resulting hot-rolled sheet was annealed at 650° C. for 15 hours, slowly cooled, and descaled by pickling to make a sample piece.

The corrosion resistance of the sample piece was examined by a combined cyclic corrosion test (CCT) combining salt spraying according to JIS Z 2371, drying, and wetting.

From the strips, two sample pieces 70 mm×150 mm were sampled. The test was performed on one surface of each strip. In testing, an eight-hour cycle combining salt spraying: 35° C., 2 hours; drying: 60° C., 4 hours; and wetting: 50° C., 2 hours was performed 30 times. The rust area in the tested surface was calculated by image analysis with a computer. The obtained area was divided by the area of the test surface to determine the rust area percentage. The average rust area percentage among two strips was defined as the rust area percentage in CCT.

Moreover, in order to examine the progress of the corrosion in the strip thickness direction, the sample pieces were immersed in 30-mass percent nitric acid at 50° C. for 8 hours to remove the rust on the test surface. The depth of the corrosion was measured using a stylus, and the maximum depth was defined as the maximum pitting corrosion depth in CCT.

A tensile test was conducted according to JIS Z 2241 to examine the elongation after fracture and the tensile strength in the rolling direction. In the test, a specimen, the longitudinal direction of which corresponds to the rolling direction, was taken from the sample piece and was formed to have a JIS Z 2201 13-B shape by machining.

A bend test was performed on a specimen having a width of 25 mm and a length of 70 mm, the longitudinal direction of which is parallel to the rolling direction. A 180° bend at an inner radius of 1.5 mm was performed on the specimen, and the outer side of the bend was observed with a magnifier to determine the presence of cracks.

Two sample pieces of the same sample number, i.e., the sample pieces having the same composition, were subjected to butt welding (MIG), wherein wire: JIS Y308, current: 150 A, voltage: 19V, welding speed: 9 mm/sec, shielding gas: 20 liter/min of 100 vol % Ar, and root gap: 1 mm. As shown in the Drawing, in the welding heat-affected zone, a 2 mm V notch was formed at the position 1 mm from the weld junction, and the absorption energy at −50° C. was measured according to JIS Z 2242. The thickness H of the Charpy impact specimen was 10 mm, the depth of the V notch being 2 mm, and the width W of the Charpy impact specimen was 3 mm, excess weld metal being removed by grinding. The length L of the Charpy impact specimen was 55 mm.

The Charpy impact test was performed on five specimens. For each specimen, the absorption energy at −50° C. was divided by the specimen cross sectional area of the notch (8 mm×3 mm) to obtain a Charpy impact value (vE-50° C.). The average value was defined as the vE-50° C. (J/cm$^2$) of the welding heat-affected zone.

The results are shown in Tables 3 and 4.

A specimen having a rust area percentage in CCT of 30% or less and a maximum pitting corrosion depth in CCT of 100 μm or less has corrosion resistance sufficient for use in vehicle structural components. When the specimen has vE-50° C. of 50 J/cm$^2$ or more at the welding heat-affected zone, the specimen has toughness sufficient for use in vehicle structural components. Moreover, when the specimen also shows an elongation after fracture of 25% or more in a tensile test and does not suffer from cracking in the bend test, the specimen has workability sufficient for use in vehicle structural components. When a specimen does not satisfy any one of the above-described characteristics, the specimen cannot be used in the vehicle structural components.

Note that the tensile strength at room temperature should be more than about 600 MPa and less than about 900 MPa to secure sufficient strength for use in vehicle structural components.

Tables 3 and 4 fully demonstrate that the invention steel sheets have superior corrosion resistance, toughness at the weld zones, and workability. The steel sheets of Comparative Examples have poor corrosion resistance, toughness at the weld zones, or workability compared to the inventive steel sheet.

EXAMPLE 2

Next, the characteristics of the cold rolled and annealed sheet was examined. The above-described hot-rolled sheet of Sample No. 13 in Table 1 of EXAMPLE 1 having a thickness of 3 mm was rolled to a thickness of 1.5 mm by cold rolling using a reverse rolling mill, and the rolled sheet was annealed at 750° C. for 1 minute. The annealed sheet was then immersed in mix acid containing 10 mass percent of nitric acid and 3 mass percent of hydrofluoric acid at 60° C. for descaling to obtain a cold rolled and annealed sheet. The same tests as in EXAMPLE 1 were performed on the cold rolled and annealed sheet. However, welding for examining the toughness at the weld zones was performed under the following conditions: current: 95 A, voltage: 11 V, welding speed: 400 mm/min, shielding gas: 20 liter/min (electrode-side), 10 liter/min (reverse-side). The results are as follows: rust area percentage in CCT: 13%, and maximum pitting corrosion depth in CCT: 35 μm. The tensile strength was 680 MPa, the elongation after fracture was 26%, and no cracks were found in the bend test. The toughness at the welding heat-affected zone at −50° C. was Charpy impact value (vE-50° C.): 100 J/cm$^2$. The cold rolled and annealed sheet had substantially the same characteristics as those of the hot-rolled sheet and, thus, achieved the target characteristics for use in vehicle structural components.

In view of the above, the steel sheet has superior corrosion resistance, toughness at the weld zones, and workability. Thus, the steel sheet can be applied to structural components of vehicles that require high corrosion resistance, high toughness at the weld zones, and high bendability.

TABLE 1

| Sample | Chemical composition (mass %) | | | | | | | | | | | |
|---|---|---|---|---|---|---|---|---|---|---|---|---|
| No. | C | Si | Mn | P | S | Cr | Ni | Mo | Al | N | Others | Reference |
| 1 | 0.006 | 0.21 | 0.33 | 0.02 | 0.003 | 11.4 | 2.14 | 1.42 | 0.023 | 0.007 | | I. Ex. |
| 2 | 0.011 | 0.25 | 0.18 | 0.02 | 0.003 | 12.8 | 2.55 | 1.13 | 0.023 | 0.003 | | I. Ex. |
| 3 | 0.008 | 0.13 | 0.34 | 0.02 | 0.003 | 12.8 | 2.70 | 0.55 | 0.013 | 0.005 | | I. Ex. |
| 4 | 0.008 | 0.25 | 0.43 | 0.03 | 0.002 | 11.8 | 2.31 | 0.59 | 0.015 | 0.006 | Ta: 0.12 | I. Ex. |
| 5 | 0.009 | 0.12 | 0.68 | 0.02 | 0.003 | 13.3 | 1.52 | 1.94 | 0.019 | 0.005 | B: 0.0015 | I. Ex. |
| 6 | 0.007 | 0.22 | 0.33 | 0.02 | 0.003 | 13.4 | 2.25 | 1.25 | 0.003 | 0.006 | Cu: 0.5 | I. Ex. |
| 7 | 0.010 | 0.12 | 0.43 | 0.02 | 0.005 | 13.7 | 1.98 | 1.24 | 0.007 | 0.003 | W: 0.09 | I. Ex. |
| 8 | 0.004 | 0.25 | 0.36 | 0.02 | 0.003 | 13.7 | 2.44 | 1.11 | 0.033 | 0.010 | | I. Ex. |
| 9 | 0.009 | 0.15 | 0.44 | 0.01 | 0.002 | 13.8 | 1.88 | 1.39 | 0.083 | 0.005 | V: 0.15 | I. Ex. |
| 10 | 0.008 | 0.12 | 0.33 | 0.02 | 0.003 | 13.3 | 2.36 | 1.21 | 0.002 | 0.005 | Co: 0.4, V: 0.05, Ti: 0.05 | I. Ex. |
| 11 | 0.008 | 0.23 | 0.31 | 0.02 | 0.002 | 13.1 | 2.55 | 1.25 | 0.013 | 0.005 | Ti: 0.16 | I. Ex. |
| 12 | 0.009 | 0.18 | 0.39 | 0.01 | 0.002 | 13.2 | 2.78 | 1.04 | 0.022 | 0.005 | Ca: 0.0015 | I. Ex. |
| 13 | 0.005 | 0.12 | 0.19 | 0.02 | 0.003 | 13.4 | 2.15 | 1.38 | 0.025 | 0.007 | | I. Ex. |
| 14 | 0.007 | 0.13 | 0.23 | 0.02 | 0.002 | 13.3 | 2.22 | 1.21 | 0.004 | 0.005 | | I. Ex. |
| 15 | 0.008 | 0.23 | 1.23 | 0.04 | 0.008 | 13.6 | 2.55 | 1.33 | 0.025 | 0.003 | Zr: 0.16 | I. Ex. |
| 16 | 0.006 | 0.92 | 0.36 | 0.02 | 0.003 | 13.5 | 2.31 | 1.21 | 0.025 | 0.008 | Cu: 1.1 | I. Ex. |
| 17 | 0.009 | 0.26 | 0.34 | 0.01 | 0.003 | 13.3 | 2.68 | 1.39 | 0.013 | 0.007 | | I. Ex. |
| 18 | 0.015 | 0.22 | 0.24 | 0.02 | 0.002 | 13.2 | 2.21 | 1.15 | 0.004 | 0.014 | Co: 0.5, Nb: 0.16 | I. Ex. |
| 19 | 0.006 | 0.22 | 0.11 | 0.02 | 0.002 | 12.4 | 3.81 | 1.12 | 0.022 | 0.008 | Mg: 0.007 | I. Ex. |
| 20 | 0.006 | 0.13 | 0.21 | 0.02 | 0.003 | 14.4 | 2.16 | 1.23 | 0.032 | 0.007 | | I. Ex. |

I. Ex. = Example of the invention

TABLE 2

| Sample No. | Chemical composition (mass %) C | Si | Mn | P | S | Cr | Ni | Mo | Al | N | Others | Reference |
|---|---|---|---|---|---|---|---|---|---|---|---|---|
| 21 | 0.022 | 0.13 | 0.13 | 0.03 | 0.003 | 13.4 | 2.15 | 1.18 | 0.005 | 0.006 | | C. Ex. |
| 22 | 0.009 | 1.11 | 0.16 | 0.04 | 0.002 | 13.3 | 2.45 | 1.23 | 0.033 | 0.005 | Co: 0.3, Ti: 0.08 | C. Ex. |
| 23 | 0.007 | 0.21 | 1.57 | 0.02 | 0.003 | 13.3 | 2.74 | 1.15 | 0.006 | 0.006 | | C. Ex. |
| 24 | 0.007 | 0.23 | 0.48 | 0.03 | 0.003 | 12.9 | 2.44 | 0.43 | 0.003 | 0.007 | | C. Ex. |
| 25 | 0.007 | 0.12 | 0.31 | 0.02 | 0.002 | 10.4 | 2.43 | 1.44 | 0.010 | 0.006 | | C. Ex. |
| 26 | 0.005 | 0.25 | 0.32 | 0.02 | 0.002 | 13.3 | 1.42 | 1.33 | 0.005 | 0.007 | | C. Ex. |
| 27 | 0.004 | 0.11 | 0.14 | 0.01 | 0.002 | 12.2 | 4.06 | 0.58 | 0.005 | 0.005 | | C. Ex. |
| 28 | 0.008 | 0.10 | 0.29 | 0.02 | 0.003 | 13.6 | 2.25 | 1.22 | 0.006 | 0.005 | Cu:2.1, Ca: 0.0015 | C. Ex. |
| 29 | 0.005 | 0.11 | 0.31 | 0.03 | 0.003 | 13.4 | 2.66 | 1.05 | 0.003 | 0.007 | Co:2.2, Nb: 0.06 | C. Ex. |
| 30 | 0.008 | 0.19 | 0.34 | 0.01 | 0.002 | 13.5 | 2.23 | 1.23 | 0.115 | 0.005 | B: 0.0009 | C. Ex. |
| 31 | 0.006 | 0.16 | 0.21 | 0.02 | 0.002 | 13.3 | 2.54 | 1.10 | 0.046 | 0.022 | Cu: 0.3 | C. Ex. |
| 32 | 0.004 | 0.15 | 1.23 | 0.02 | 0.005 | 11.1 | 2.05 | 0.58 | 0.003 | 0.007 | | C. Ex. |
| 33 | 0.013 | 0.12 | 0.34 | 0.02 | 0.002 | 12.6 | 2.48 | 1.15 | 0.005 | 0.018 | | C. Ex. |
| 34 | 0.005 | 0.07 | 0.06 | 0.02 | 0.002 | 13.3 | 1.56 | 0.67 | 0.010 | 0.003 | | C. Ex. |
| 35 | 0.005 | 0.53 | 0.08 | 0.03 | 0.002 | 14.0 | 2.36 | 1.38 | 0.002 | 0.007 | Ti:0.25 | C. Ex. |
| 36 | 0.007 | 0.24 | 0.12 | 0.02 | 0.003 | 14.7 | 2.86 | 1.42 | 0.012 | 0.006 | | C. Ex. |
| 37 | 0.005 | 0.27 | 0.36 | 0.02 | 0.003 | 13.3 | 3.65 | 1.33 | 0.011 | 0.007 | | C. Ex. |
| 38 | 0.007 | 0.18 | 0.28 | 0.02 | 0.002 | 13.1 | 2.13 | 1.58 | 0.006 | 0.007 | | C. Ex. |
| 39 | 0.005 | 0.25 | 0.43 | 0.02 | 0.002 | 15.6 | 2.22 | 1.03 | 0.003 | 0.005 | | C. Ex. |

C. Ex. = Comparative Example

TABLE 3

| Sample No. | Value of middle part of relationship (1) or (5) | Value af the left side of relation-ship (2) | Value af the left side of relationship (3) or (6) | Value of middle part of relationship (4) or (7) | Rust area percent-age in CCT (%) | Maximum pitting depth in CCT (μm) | Tensile strength (MPa) | Elon-gation (%) | Bend test (presence of cracks) | Charpy impact value of welding heat-affected zone at −50° C. (J/cm$^2$) | Reference |
|---|---|---|---|---|---|---|---|---|---|---|---|
| 1 | 16.1 | 0.013 | 3.2 | 12.0 | 27 | 68 | 698 | 28 | None | 121 | I. Ex. |
| 2 | 17.6 | 0.014 | 3.5 | 13.4 | 12 | 35 | 733 | 27 | None | 79 | I. Ex. |
| 3 | 16.9 | 0.013 | 3.4 | 13.2 | 25 | 72 | 739 | 27 | None | 116 | I. Ex. |
| 4 | 15.5 | 0.014 | 3.1 | 12.3 | 28 | 83 | 710 | 28 | None | 135 | I. Ex. |
| 5 | 18.0 | 0.014 | 3.1 | 10.6 | 13 | 45 | 664 | 29 | None | 72 | I. Ex. |
| 6 | 18.2 | 0.013 | 3.5 | 12.8 | 17 | 46 | 721 | 28 | None | 110 | I. Ex. |
| 7 | 17.9 | 0.013 | 3.1 | 11.2 | 15 | 33 | 638 | 29 | None | 67 | I. Ex. |
| 8 | 18.3 | 0.014 | 3.3 | 13.0 | 12 | 41 | 725 | 25 | None | 62 | I. Ex. |
| 9 | 18.1 | 0.014 | 3.1 | 11.1 | 17 | 45 | 666 | 29 | None | 89 | I. Ex. |
| 10 | 18.1 | 0.013 | 3.4 | 12.8 | 13 | 30 | 726 | 25 | None | 118 | I. Ex. |
| 11 | 18.0 | 0.013 | 3.6 | 13.5 | 10 | 27 | 740 | 27 | None | 109 | I. Ex. |
| 12 | 18.1 | 0.014 | 3.8 | 14.3 | 19 | 42 | 768 | 27 | None | 116 | I. Ex. |
| 13 | 18.1 | 0.012 | 3.1 | 11.4 | 12 | 39 | 687 | 28 | None | 106 | I. Ex. |
| 14 | 17.8 | 0.012 | 3.2 | 11.6 | 15 | 39 | 694 | 28 | None | 107 | I. Ex. |
| 15 | 18.7 | 0.011 | 4.1 | 15.4 | 27 | 60 | 793 | 25 | None | 118 | I. Ex. |
| 16 | 18.6 | 0.014 | 3.8 | 15.8 | 8 | 31 | 747 | 27 | None | 59 | I. Ex. |
| 17 | 18.6 | 0.016 | 3.8 | 14.5 | 7 | 25 | 766 | 25 | None | 62 | I. Ex. |
| 18 | 17.7 | 0.029 | 3.4 | 13.2 | 6 | 36 | 730 | 25 | None | 56 | I. Ex. |
| 19 | 18.7 | 0.014 | 4.6 | 18.0 | 5 | 33 | 871 | 25 | None | 120 | I. Ex. |
| 20 | 18.8 | 0.013 | 3.1 | 11.4 | 5 | 29 | 687 | 28 | None | 59 | I. Ex. |

I. Ex. = Example of the invention

TABLE 4

| Sample No. | Value of middle part of relationship (1) or (5) | Value at the left side of relation-ship (2) | Value at the left side of relationship (3) or (6) | Value of middle part of relationship (4) or (7) | Rust area percent-age in CCT (%) | Maximum pitting depth in CCT (μm) | Tensile strength (MPa) | Elon-gation (%) | Bend test (presence of cracks) | Charpy impact value of welding heat-affected zone at −50° C. (J/cm$^2$) | Reference |
|---|---|---|---|---|---|---|---|---|---|---|---|
| 21 | 17.8 | 0.028 | 3.5 | 12.3 | 15 | 36 | 711 | 18 | Cracked | 18 | C. Ex. |
| 22 | 18.2 | 0.014 | 3.4 | 15.8 | 14 | 44 | 727 | 17 | Cracked | 29 | C. Ex. |
| 23 | 18.3 | 0.013 | 4.3 | 16.6 | 54 | 105 | 832 | 15 | Cracked | 102 | C. Ex. |
| 24 | 16.5 | 0.014 | 3.1 | 12.6 | 61 | 125 | 715 | 28 | None | 119 | C. Ex. |
| 25 | 15.5 | 0.013 | 3.5 | 12.9 | 96 | 221 | 731 | 27 | None | 118 | C. Ex. |
| 26 | 17.0 | 0.012 | 2.4 | 9.0 | 47 | 136 | 594 | 33 | None | 65 | C. Ex. |
| 27 | 17.9 | 0.009 | 4.5 | 17.9 | 11 | 36 | 878 | 14 | Cracked | 117 | C. Ex. |
| 28 | 19.2 | 0.013 | 4.3 | 14.0 | 6 | 31 | 766 | 17 | Cracked | 41 | C. Ex. |
| 29 | 18.8 | 0.012 | 3.5 | 15.0 | 6 | 33 | 788 | 16 | Cracked | 36 | C. Ex. |
| 30 | 18.0 | 0.013 | 3.3 | 12.2 | 47 | 131 | 704 | 28 | None | 20 | C. Ex. |
| 31 | 18.1 | 0.028 | 3.5 | 13.8 | 16 | 41 | 757 | 17 | Cracked | 22 | C. Ex. |

TABLE 4-continued

| Sample No. | Value of middle part of relationship (1) or (5) | Value at the left side of relationship (2) | Value at the left side of relationship (3) or (6) | Value of middle part of relationship (4) or (7) | Rust area percentage in CCT (%) | Maximum pitting depth in CCT (μm) | Tensile strength (MPa) | Elongation (%) | Bend test (presence of cracks) | Charpy impact value of welding heat-affected zone at −50° C. (J/cm$^2$) | Reference |
|---|---|---|---|---|---|---|---|---|---|---|---|
| 32 | 14.4 | 0.011 | 3.1 | 12.3 | 94 | 156 | 615 | 30 | None | 103 | C. Ex. |
| 33 | 17.3 | 0.031 | 3.6 | 13.8 | 11 | 25 | 759 | 17 | Cracked | 44 | C. Ex. |
| 34 | 16.2 | 0.008 | 2.1 | 7.7 | 17 | 39 | 586 | 30 | None | 65 | C. Ex. |
| 35 | 18.9 | 0.012 | 3.2 | 13.2 | 6 | 36 | 915 | 14 | Cracked | 76 | C. Ex. |
| 36 | 20.3 | 0.013 | 3.8 | 14.6 | 5 | 31 | 769 | 17 | Cracked | 68 | C. Ex. |
| 37 | 19.7 | 0.012 | 4.6 | 18.1 | 3 | 48 | 910 | 14 | Cracked | 88 | C. Ex. |
| 38 | 18.0 | 0.014 | 3.3 | 12.0 | 13 | 33 | 700 | 28 | None | 41 | C. Ex. |
| 39 | 19.8 | 0.010 | 3.1 | 12.1 | 4 | 26 | 697 | 28 | None | 19 | C. Ex. |

C. Ex. = Comparative Example

What is claimed is:

1. A welded vehicle structural component having a welding heat-affected zone comprising:

a martensitic stainless steel sheet having superior workability comprising, on a mass basis, less than about 0.02% of carbon;

about 1.0% or less of silicon;

less than about 1.5% of manganese;

about 0.04% or less of phosphorus;

about 0.01% or less of sulfur;

about 0.05% or less of aluminum;

about 1.5% or more and less than about 4.0% of nickel;

more than 13.0% and less than about 15% of chromium;

about 0.5% to less than 1.5% of molybdenum; and less than about 0.02% of nitrogen, the balance being iron and unavoidable impurities, wherein relationships (1) to (4) are satisfied:

$$15.0\% \leqq [Cr]+1.5\times[Mo]+1.2\times[Ni] \leqq 20.0\% \quad (1)$$

$$[C]+[N]<0.030\% \quad (2)$$

$$[Ni]+0.5\times([Mn]+[Mo])+30\times[C]>3.0\% \quad (3)$$

$$8.0\% \leqq 72\times[C]+40\times[N]+3\times[Si]+2\times[Mn]+4\times[Ni]+[Mo] \leqq 18.0\% \quad (4).$$

wherein the steel sheet is 1) a cold rolled steel sheet having a thickness of 0.3-3.0 mm or 2) a hot rolled steel sheet having a thickness of 1.5-8.0 mm and generates a Charpy impact value of the welding heat-affected zone at −50° C. of 50J/cm$^2$ or more and a tensile strength of more than about 600 MPa.

2. The component according to claim 1, further comprising, on a mass basis:

at least one of about 0.2% or less of titanium, about 0.2% or less of niobium, about 0.2% or less of vanadium, about 0.2% or less of zirconium, and about 0.2% or less of tantalum.

3. The component according to claim 1, further comprising, on a mass basis:

at least one of about 0.005% or less of boron and about 0.005% or less of calcium.

4. The component according to claim 1, further comprising, on a mass basis:

at least one of about 0.1% or less of tungsten and about 0.01% or less of magnesium.

5. A vehicle comprising the vehicle structural component according to claim 1.

6. A welded vehicle structural component having a welding heat-affected zone component comprising:

a martensitic stainless steel sheet having superior workability comprising, on a mass basis, less than about 0.02% of carbon;

about 1.0% or less of silicon;

less than about 1.5% of manganese;

about 0.04% or less of phosphorus;

about 0.01% or less of sulfur;

about 0.05% or less of aluminum;

about 1.5% or more and less than about 4.0% of nickel;

more than 13.0% and less than about 15% of chromium;

about 0.5% to less than about 1.5% of molybdenum;

less than about 0.02% of nitrogen; and

0% to about 2.0% of copper and 0% to about 2.0% of cobalt, the balance being iron and unavoidable impurities, wherein relationships (2) and (5) to (7) are satisfied:

$$[C]+[N]<0.030\% \quad (2)$$

$$15.0\% \leqq [Cr]+1.5\times[Mo]+1.2\times[Ni]+0.5\times[Cu]+0.3\times[Co] \leqq 20.0\% \quad (5)$$

$$[Ni]+0.5\times([Mn]+[Mo]+[Cu])+30\times[C]>3.0\% \quad (6)$$

$$8.0\% \leqq 72\times[C]+40\times[N]+3\times[Si]+2\times[Mn]+4\times[Ni]+[Mo]+[Cu]+0.8\times[Co] \leqq 18.0\% \quad (7)$$

wherein the steel sheet is 1) a cold rolled steel sheet having a thickness of 0.3-3.0 mm or 2) a hot rolled steel sheet having a thickness of 1.5-8.0 mm and generates a Charpy impact value of the welding heat-affected zone at −50° C. of 50J/cm$^2$ or more and a tensile strength of more than about 600 MPa.

7. The component according to claim 6, further comprising, on a mass basis:

at least one of about 0.2% or less of titanium, about 0.2% or less of niobium, about 0.2% or less of vanadium, about 0.2% or less of zirconium, and about 0.2% or less of tantalum.

8. The component according to claim 6, further comprising, on a mass basis:

at least one of about 0.005% or less of boron and about 0.005% or less of calcium.

9. The component according to claim 6, further comprising, on a mass basis:

at least one of about 0.1% or less of tungsten and about 0.01% or less of magnesium.

10. A vehicle comprising the vehicle structural component according to claim 6.

11. The component according to claim 1, wherein manganese is present in an amount of 0.1-0.39%.

12. The component according to claim 6, wherein manganese is present in an amount of 0.1-0.39%.

13. The component according to claim 2, further comprising, on a mass basis:

at least one of about 0.005% or less of boron and about 0.005% or less of calcium.

14. The component according to claim 2, further comprising, on a mass basis:

at least one of about 0.1% or less of tungsten and about 0.01% or less of magnesium.

15. A vehicle comprising the vehicle structural component according to claim 2.

16. The component according to claim 2, wherein manganese is present in an amount of 0.1-0.39%.

17. The component according to claim 3, further comprising, on a mass basis:

at least one of about 0.1% or less of tungsten and about 0.01% or less of magnesium.

18. A vehicle comprising the vehicle structural component according to claim 3.

19. A vehicle comprising the vehicle structural component according to claim 4.

20. The component according to claim 3, wherein manganese is present in an amount of 0.1-0.39%.

21. The component according to claim 4, wherein manganese is present in an amount of 0.1-0.39%.

22. The component according to claim 5, wherein manganese is present in an amount of 0.1-0.39%.

23. The component according to claim 7, further comprising, on a mass basis:

at least one of about 0.005% or less of boron and about 0.005% or less of calcium.

24. The component according to claim 7, further comprising, on a mass basis:

at least one of about 0.1% or less of tungsten and about 0.01% or less of magnesium.

25. A vehicle comprising the vehicle structural component according to claim 7.

26. The component according to claim 7, wherein manganese is present in an amount of 0.1-0.39%.

27. The component according to claim 8, further comprising, on a mass basis:

at least one of about 0.1% or less of tungsten and about 0.01% or less of magnesium.

28. A vehicle comprising the vehicle structural component according to claim 8.

29. A vehicle comprising the vehicle structural component according to claim 9.

30. The component according to claim 8, wherein manganese is present in an amount of 0.1-0.39%.

31. The component according to claim 9, wherein manganese is present in an amount of 0.1-0.39%.

32. The component according claim to 10, wherein manganese is present in an amount of 0.1-0.39%.

33. The component according to claim 13, further comprising, on a mass basis:

at least one of about 0.1% or less of tungsten and about 0.01% or less of magnesium.

34. A vehicle comprising the vehicle structural component according to claim 13.

35. A vehicle comprising the vehicle structural component according to claim 14.

36. The component according to claim 13, wherein manganese is present in an amount of 0.1-0.39%.

37. The component according to claim 14, wherein manganese is present in an amount of 0.1-0.39%.

38. The component according to claim 15, wherein manganese is present in an amount of 0.1-0.39%.

39. The component according to claim 23, further comprising, on a mass basis:

at least one of about 0.1% or less of tungsten and about 0.01% or less of magnesium.

40. A vehicle comprising the vehicle structural component according to claim 23.

41. A vehicle comprising the vehicle structural component according to claim 24.

42. The component according to claim 23, wherein manganese is present in an amount of 0.1-0.39%.

43. The component according to claim 24, wherein manganese is present in an amount of 0.1-0.39%.

44. A vehicle comprising the vehicle structural component according to claim 25.

* * * * *